US006751163B1

(12) United States Patent
Miyakawa

(10) Patent No.: US 6,751,163 B1
(45) Date of Patent: Jun. 15, 2004

(54) CLOCK ADJUSTING METHOD AND ELECTRONIC EQUIPMENT USING THE METHOD

(75) Inventor: Kazuhisa Miyakawa, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/340,965

(22) Filed: Jun. 28, 1999

(30) Foreign Application Priority Data

Jun. 30, 1998 (JP) ..... 10-185242

(51) Int. Cl.[7] ..... G04C 11/02; G04C 13/04; G04C 13/08

(52) U.S. Cl. ..... 368/46; 47/52; 47/59

(58) Field of Search ..... 368/43, 46–52, 368/59–60

(56) References Cited

U.S. PATENT DOCUMENTS 3,852,953 A * 12/1974 Mischiatti ..... 368/47
4,014,166 A * 3/1977 Cateora ..... 368/47

* cited by examiner

*Primary Examiner*—David Martin
*Assistant Examiner*—Michael L. Lindinger
(74) *Attorney, Agent, or Firm*—Squire, Sanders & Dempsey, LLP

(57) ABSTRACT

A clock adjusting method and an electronic equipment using the method are disclosed in which a clock portion of an electronic equipment is correctly and simply adjusted by use of time information in broadcasting waves. In the case where a time indicated by the clock portion of the electronic equipment is "0:00" a.m. or after "0:00" and before "23:00", the time of the clock portion is set at a reference time based on the time information. In the other case, the judgement is made of whether the time of the clock portion indicates a time of the next day as compared with the reference time or a time of the preceding day as compared with the reference time. When the time of the clock portion indicates a time of the next day as compared with the reference time, the time of the clock portion is set at the reference time while a day of the week indicated by the clock portion is put back one day. When the time of the clock portion indicates a time of the preceding day as compared with the reference time, the time of the clock portion is set at the reference time while the day of the week of the clock portion is put forward one day.

5 Claims, 5 Drawing Sheets

| CLOCK PORTION OF AUDIO EQUIPMENT | | TIME INFORMATION FROM BROADCASTING STATION | CLOCK PORTION OF AUDIO EQUIPMENT AFTER ADJUSTMENT | |
|---|---|---|---|---|
| DAY OF WEEK WD | TIME Ta | REFERENCE TIME Tref | DAY OF WEEK WD | TIME Ta |
| A | 0 : 00 ≦ Ta < 1 : 00 | 0 : 00 ≦ Tref < 1 : 00<br>1 : 00 ≦ Tref <23 : 00<br>23 : 00 ≦ Tref < 0 : 00 | A<br>A<br>A–1 | Tref<br>Tref<br>Tref |
| A | 1 : 00 ≦ Ta <23 : 00 | 0 : 00 ≦ Tref < 1 : 00<br>1 : 00 ≦ Tref <23 : 00<br>23 : 00 ≦ Tref < 0 : 00 | A<br>A<br>A | Tref<br>Tref<br>Tref |
| A | 23 : 00 ≦ Ta < 0 : 00 | 0 : 00 ≦ Tref < 1 : 00<br>1 : 00 ≦ Tref <23 : 00<br>23 : 00 ≦ Tref < 0 : 00 | A+1<br>A<br>A | Tref<br>Tref<br>Tref |

FIG. 4

| CLOCK PORTION OF AUDIO EQUIPMENT | | TIME INFORMATION FROM BROADCASTING STATION | CLOCK PORTION OF AUDIO EQUIPMENT AFTER ADJUSTMENT | |
|---|---|---|---|---|
| DAY OF WEEK WD | TIME Ta | REFERENCE TIME Tref | DAY OF WEEK WD | TIME Ta |
| A | 0 : 00 ≦ Ta < 1 : 00 | 0 : 00 ≦ Tref < 1 : 00<br>1 : 00 ≦ Tref <23 : 00<br>23 : 00 ≦ Tref < 0 : 00 | A<br>A<br>A−1 | Tref<br>Tref<br>Tref |
| A | 1 : 00 ≦ Ta <23 : 00 | 0 : 00 ≦ Tref < 1 : 00<br>1 : 00 ≦ Tref <23 : 00<br>23 : 00 ≦ Tref < 0 : 00 | A<br>A<br>A | Tref<br>Tref<br>Tref |
| A | 23 : 00 ≦ Ta < 0 : 00 | 0 : 00 ≦ Tref < 1 : 00<br>1 : 00 ≦ Tref <23 : 00<br>23 : 00 ≦ Tref < 0 : 00 | A+1<br>A<br>A | Tref<br>Tref<br>Tref |

| CLOCK PORTION OF AUDIO EQUIPMENT | TIME INFORMATION FROM BROADCASTING STATION | CLOCK PORTION OF AUDIO EQUIPMENT AFTER ADJUSTMENT |
|---|---|---|
| TUESDAY 23:58 | (WEDNESDAY) 0:02 | TUESDAY 0:02 |
| TUESDAY 0:02 | (MONDAY) 23:58 | TUESDAY 23:58 |

CLOCK ADJUSTING METHOD AND ELECTRONIC EQUIPMENT USING THE METHOD

BACKGROUND OF THE INVENTION

The present invention relates to a clock adjusting method for electronic equipment, and more particularly to the correct adjustment of a day of the week and a time indicated by clock means of an electronic equipment by discriminating the time of the clock means and a reference time obtained through the reception of broadcasting waves with reference time information and adjusting the day of the week of the clock means on the basis of the result of discrimination while setting the time of the clock means at the reference time.

In the conventional electronic equipment, for example, an audio equipment capable of recording a broadcasting program of a radio casting into a recording medium and reproducing a music or the like recorded in the recording medium, a desired broadcasting program can be recorded simply by a timer recording function. In this audio equipment, a clock indicating a day of the week and a time is incorporated so that in order to enable the recording even in the case where the broadcasting dates of desired broadcasting programs are different, not only the designation of the instant of time of recording start and the instant of time of recording end or a recording time but also the designation of a broadcasting day of the week of the program are possible at the time of timer recording. Therefore, it is possible to make the recording reservation of broadcasting programs over one week.

In order to correctly record a desired broadcasting program, it is required that the clock incorporated in the audio equipment should be placed in a correctly adjusted condition. For that purpose, broadcasting waves including the multiplexed form of message data indicative of broadcasting station information, traffic information, date/time information and so forth, for example, as in a RDS (Radio Data System) broadcasting practiced in Europe are received so that the clock is adjusted using the obtained time information.

However, when not only information of a time but also information of a date or the like are to be obtained from a received signal, a complicated operation processing is required to obtain information of "month", "day" and "day of week" since information of a date or the like is represented using a corrected Julian calendar in the case of the RDS broadcasting.

Also, assume the case where the adjustment based on the acquisition of only time information from a received signal is made in order to provide the simple adjustment of the clock of the audio equipment. In this case, if the adjustment of the clock is made at a timing near to 0:00 a.m. at which a day of the week changes, there may occur the case where a day of the week is not correctly adjusted.

For example, in the case where the clock of the audio equipment goes slow or indicates "23:58 on Tuesday" when a correct time is "0:02 on Wednesday", as shown in FIG. 6, the adjustment of the clock of the audio equipment results in the adjustment to "0:02 on Tuesday", that is, a state in which a day of the week is put back one day. Also, in the case where the clock of the audio equipment goes fast or indicates "0:02 on Tuesday" when a correct time is "23:58 on Monday", the adjustment of the clock of the audio equipment results in the adjustment to "23:58 on Tuesday", that is, a state in which a day of the week is put forward one day.

SUMMARY OF THE INVENTION

An object of the present invention is to provide a clock adjusting method and an electronic equipment in which a clock of an electronic equipment can correctly be adjusted using time information.

A clock adjusting method according to the present invention comprises a step in which a reference time and a time indicated by a clock portion are compared, a step in which when the time of the clock portion is in a first time range from 0:00 a.m. and the reference time is in a second time range before 0:00 a.m., the time of the clock portion is set at the reference time while a day of the week indicated by the clock portion is put back one day, and a step in which when the time of the clock portion is in a third time range before 0:00 a.m. and the reference time is in a fourth time range from 0:00 a.m., the time of the clock portion is set at the reference time while the day of the week of the clock portion is put forward one day.

Also, an electronic equipment according to the present invention comprises receiving means for receiving broadcasting waves with reference time information to obtain a reference time, and clock adjusting means for discriminating a time indicated by clock means and the reference time information obtained by the receiving means so that a day of the week indicated by the clock means is adjusted on the basis of the result of discrimination while the time indicated by the clock means is set at the reference time obtained by the receiving means.

In the case where the discrimination of the time indicated by the clock means and the reference time obtained through the reception of the broadcasting waves results in that when the time indicated by the clock means is in a first time range from 0:00 a.m., the reference time indicates a time of the preceding day which is in a second time range before 0:00 a.m., the day of the week of the clock means is put back one day. Also, in the case where when the time indicated by the clock means is in a third time range before 0:00 a.m., the reference time indicates a time of the next day which is in a fourth time range from 0:00 a.m., the day of the week of the clock means is put forward one day.

Further, in the case where the announcement of time of 0:00 a.m. is detected when the time indicated by the clock means is in a fifth time range before 0.00 a.m., the clock adjustment is made with the day of the week of the clock means being put forward one day.

BRIEF DESCRIPTION OF THE DRAWINGS

FIG. 4 is a table showing the result of adjustment of the clock portion;

DESCRIPTION OF THE EMBODIMENTS

Figure 1:
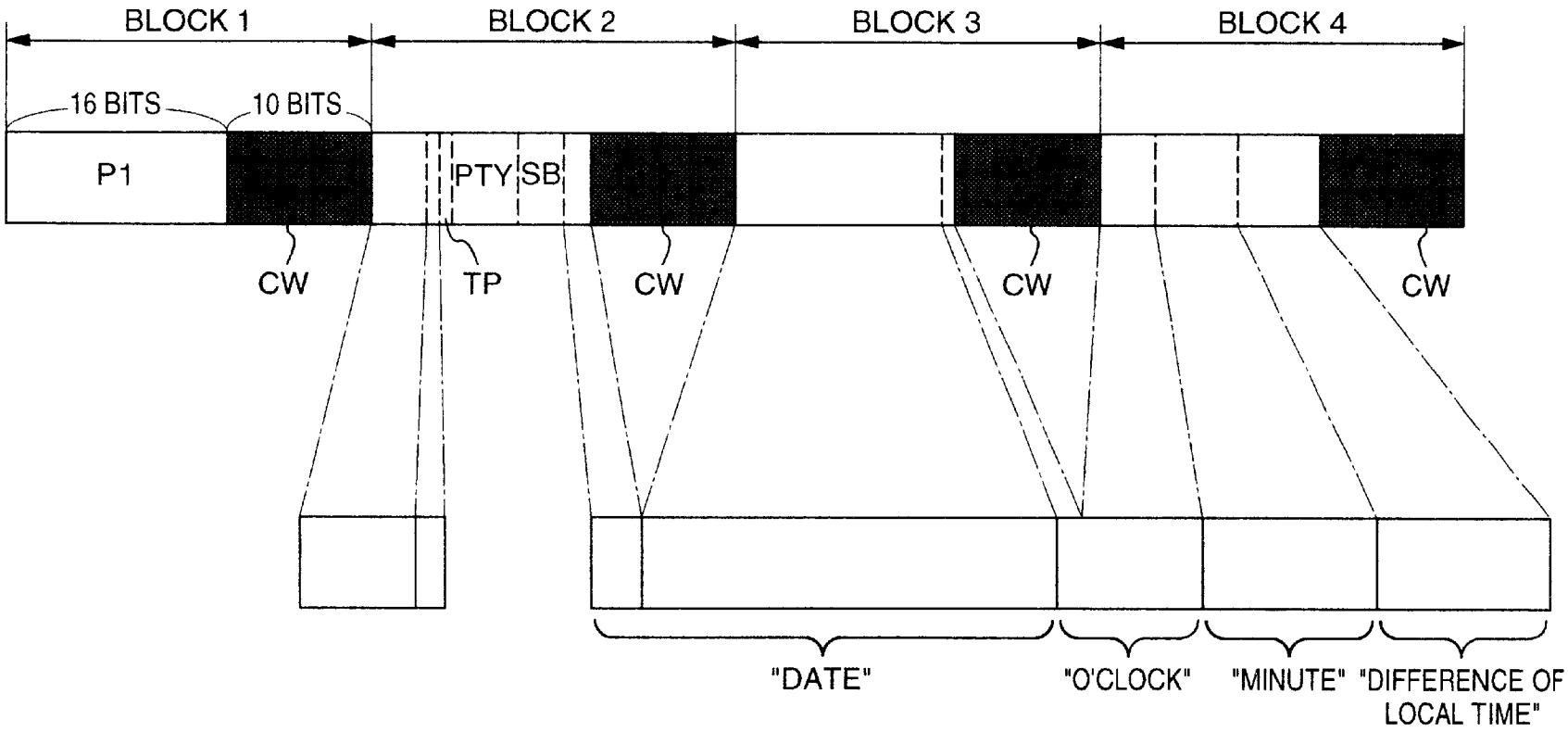
FIG. 1 is a diagram showing a format of message data.

The details of the present invention will now be described in conjunction with embodiments by use of the drawings. FIG. 1 shows a format of multiplexed message data in broadcasting waves with time information received by an electronic equipment, for example, RDS (Radio Data System) broadcasting waves.

The message data is constituted in the unit of 104 bits called "group". Each group includes four "blocks" each of which has 26 bits. Each block is composed of an information word of 16 bits and an error detecting/correcting check word CW of 10 bits. The information word indicates broadcasting station information, traffic information, date/time information and so forth. In FIG. 1, message data indicating date/time information is shown.

"PI" in a block 1 is a broadcasting station identifying code which indicates what broadcasting station of what country is data broadcast from, and so forth. Also, what data is message data can be discriminated by the data value of a group type in a block 2. "TP" in the block 2 indicates whether or not this broadcasting station broadcasts traffic information, and "PTY" therein indicates the type of a program which is being broadcast. Subsequently to "PTY", a space bit "SB" is provided. Subsequently to "SB", "date", "o'clock" and "minute" are indicated. This "date" is represented by use of a corrected Julian calendar and is coded by a binary number of 17 bits. By performing an operation processing on data indicative of the "date", it is possible to obtain information of a month, a day, a day of the week and so forth. Also, "o'clock" and "minute" are represented by means of an international agreed time (a regional time information according to RBS broadcasting standard), and the difference of a local time from the international agreed time is indicated by six last bits in units of 30 minutes. Therefore, correct time information corresponding to a locality can be obtained from "o'clock", "minute" and "difference of local time".

Figure 2:
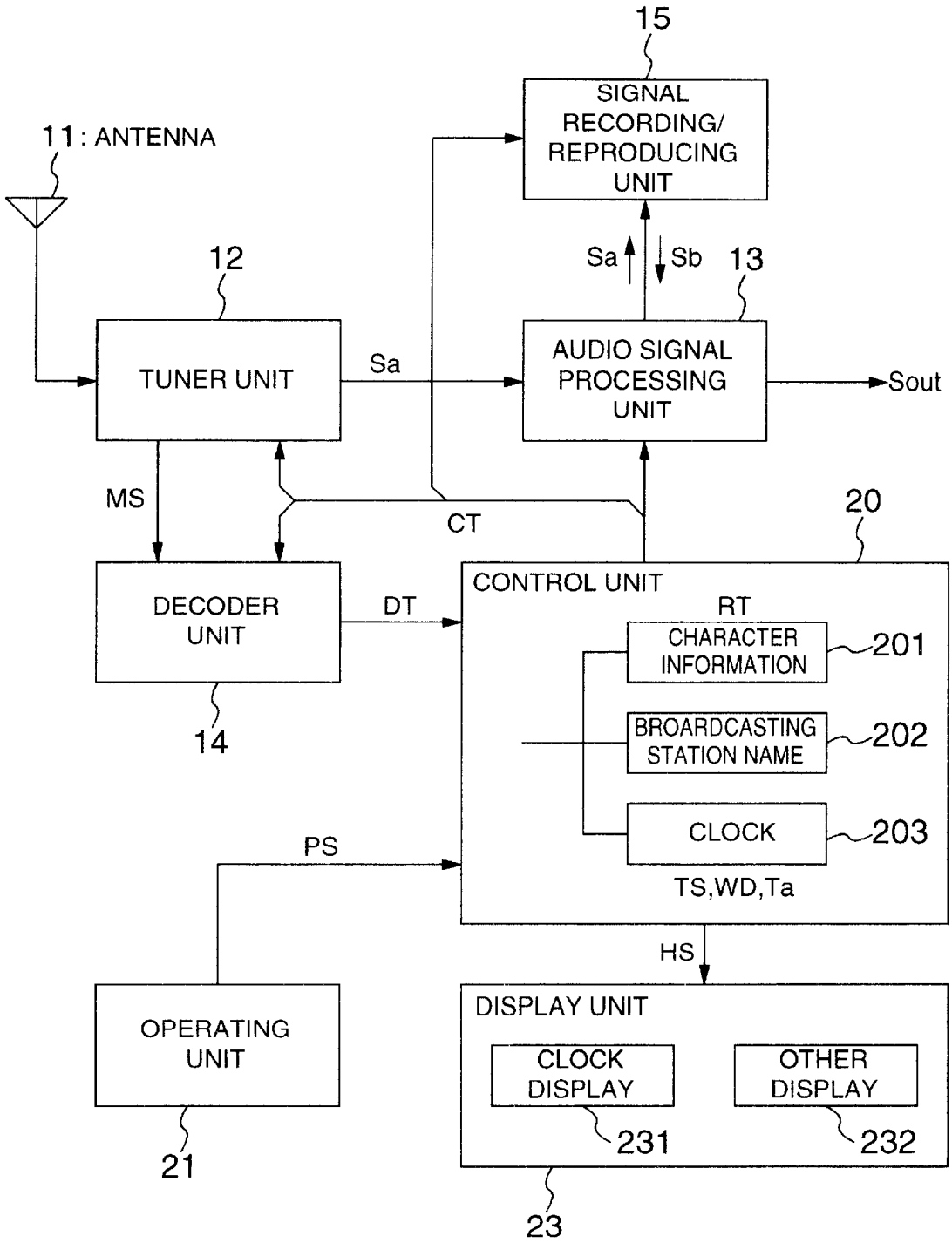
FIG. 2 is a block diagram showing the construction of an audio equipment.

FIG. 2 is a block diagram of an electronic equipment capable of receiving broadcasting waves such as RDS broadcasting waves, for example, an audio equipment.

A receive signal obtained by receiving broadcasting waves through an antenna 11 is supplied to a tuner unit 12 which forms receiving means. The tuner unit 12 makes the selection of a desired broadcasting station on the basis of a control signal CT from a control unit 20 (which will be described later on) and generates a composite signal by amplifying and detecting an obtained intermediate frequency signal. Further, the tuner unit 12 performs a stereophonic demodulation processing or the like for the composite signal to generate an audio signal Sa and supplies the audio signal Sa to an audio signal processing unit 13. Also, a message data signal MS subjected to AM-modulation by a multiplexed subcarrier of 57 KHz is separated from the composite signal by the tuner unit 12 and is then supplied to a decoder unit 14 which forms receiving means.

The audio signal processing unit 13 supplies the audio signal Sa from the tuner unit 12 to a signal recording/reproducing unit 15 on the basis of the control signal CT from the control unit 20. Also, the audio signal Sa or a reproduction audio signal Sb obtained through a reproduction processing by the signal recording/reproducing unit 15 for a recording medium is amplified to a desired level by the audio signal processing unit 13 and is then outputted therefrom as an audio output signal Sout.

In the decoder unit 14, a decode processing for the message data signal MS is performed to generate an information data signal DT indicating broadcasting station information, traffic information, time information and so forth which is to be supplied to the control unit 20.

In the signal recording/reproducing unit 15, the recording of the audio signal Sa supplied from the audio signal processing unit 13 is made by use of a recording medium such as a magnetic tape, optical disk or the like. Also, the reproduction audio signal Sb obtained through a reproduction processing for the recording medium is supplied to the audio signal processing unit 13.

An operating unit 21 is connected to the control unit 20. When the operating unit 21 is operated, an operation signal PS corresponding to the operation is supplied to the control unit 20. In the control unit 20, a control signal CT is generated on the basis of the operation signal PS to control the operation of the tuner unit 12, the audio signal processing unit 13, the decoder unit 14 and the signal recording/reproducing unit 15.

The control unit 20 has a clock portion 203 incorporated therein. At the time of timer recording operation, a recording operation is controlled on the basis of a day of the week WD and a time Ta indicated by a clock information signal TS from the clock portion 203. Further, the control unit 20 includes a character information detecting portion 201 and a broadcasting station name detecting portion 202.

In the control unit 20 which is clock adjusting means, an adjusting signal TR for adjusting the clock portion 203 is generated from a reference time Tref based on the information data signal DT from the decoder unit 14 and the time Ta based on the clock information signal TS from the clock portion 203 and is then supplied to the clock portion 203. In the clock portion 203, the day of the week WD and the time Ta are correctly adjusted on the basis of the adjusting signal TR.

Also, a display unit 23 including a clock display portion 231 and another display portion 232 is connected to the control unit 20 to display the operating condition of the audio equipment, the day of the week WD and the time Ta, broadcasting station information, traffic information or the like on the basis of a display signal HS by generated the control unit 20.

Next, the operation for adjustment of the clock portion 203 will be described using a time chart shown in FIG. 3. It is assumed that a time referred to in the following description is denoted by a representation based on a 24-hour system.

First or in step ST1, the judgement is made of whether or not a time Ta indicated by the clock portion 203 at the time of clock adjustment is "1:00" or after "1:00" and before "23:00". When the time Ta is in a range equal to "1:00" or after "1:00" and before "23:00", the flow proceeds to step ST2. When Ta is not in that time range, the flow proceeds to step ST3.

In step ST2, the time Ta of the clock portion 203 is adjusted by an adjusting signal TR from the control unit 20 to a reference time Tref based on an information data signal DS from the decoder unit 14, thereby completing the operation for adjustment of the clock portion 203.

In step ST3 when the flow proceeds from step STI to step ST3, the judgement is made of whether or not the time Ta of the clock portion 203 is "0:00" or after "0:00" and before "1:00". When the time Ta is in a range equal to "0:00" or after "0:00" and before "1:00", the flow proceeds to step ST4. When Ta is not in that time range, the flow proceeds to step ST6.

In step ST4, the judgement is made of whether or not a reference time Tref based on an information data signal DS from the decoder unit 14 is "23:00" or after "23:00" and before "0:00". When the reference time Tref is not in a range equal to "23:00" or after "23:00" and before "0:00", the flow proceeds to step ST2 in which the time Ta of the clock portion 203 is adjusted to the reference time Tref based on the information data signal from the decoder unit 14, thereby completing the operation for adjustment of the clock portion 203. When Tref is in the time range, the flow proceeds to step ST5.

In step ST5, the time Ta of the clock portion 203 is adjusted by an adjusting signal TR from the control unit 20 to the reference time Tref while a day of the week indicated by the clock portion 203 is put back one day, thereby completing the adjustment of the clock portion 203.

In step ST6 when the flow proceeds from step ST3 to step ST6, the judgement is made of whether or not a reference time Tref based on an information data signal DS from the decoder unit 14 is "0:00" or after "0:00" and before "1:00". When the reference time Tref is not in a range equal to "0:00" or after "0:00" and before "1:00", the flow proceeds to step ST2 in which the time Ta of the clock portion 203 is adjusted to the reference time Tref, thereby completing the adjustment of the clock portion 203. When Tref is in the time range, the flow proceeds to step ST7.

In step ST7, the time Ta of the clock portion 203 is adjusted by an adjusting signal TR from the control unit 20 to the reference time Tref while a day of the week indicated by the clock portion 203 is put forward one day, thereby completing the adjustment of the clock portion 203.

In the present embodiment, it is assumed that a possible time deviation generally possessed by a clock is several minutes. On the basis of this assumption, there is monitored one hour around (or before and after) 0:00 at which a day of the week changes.

Figure 3:
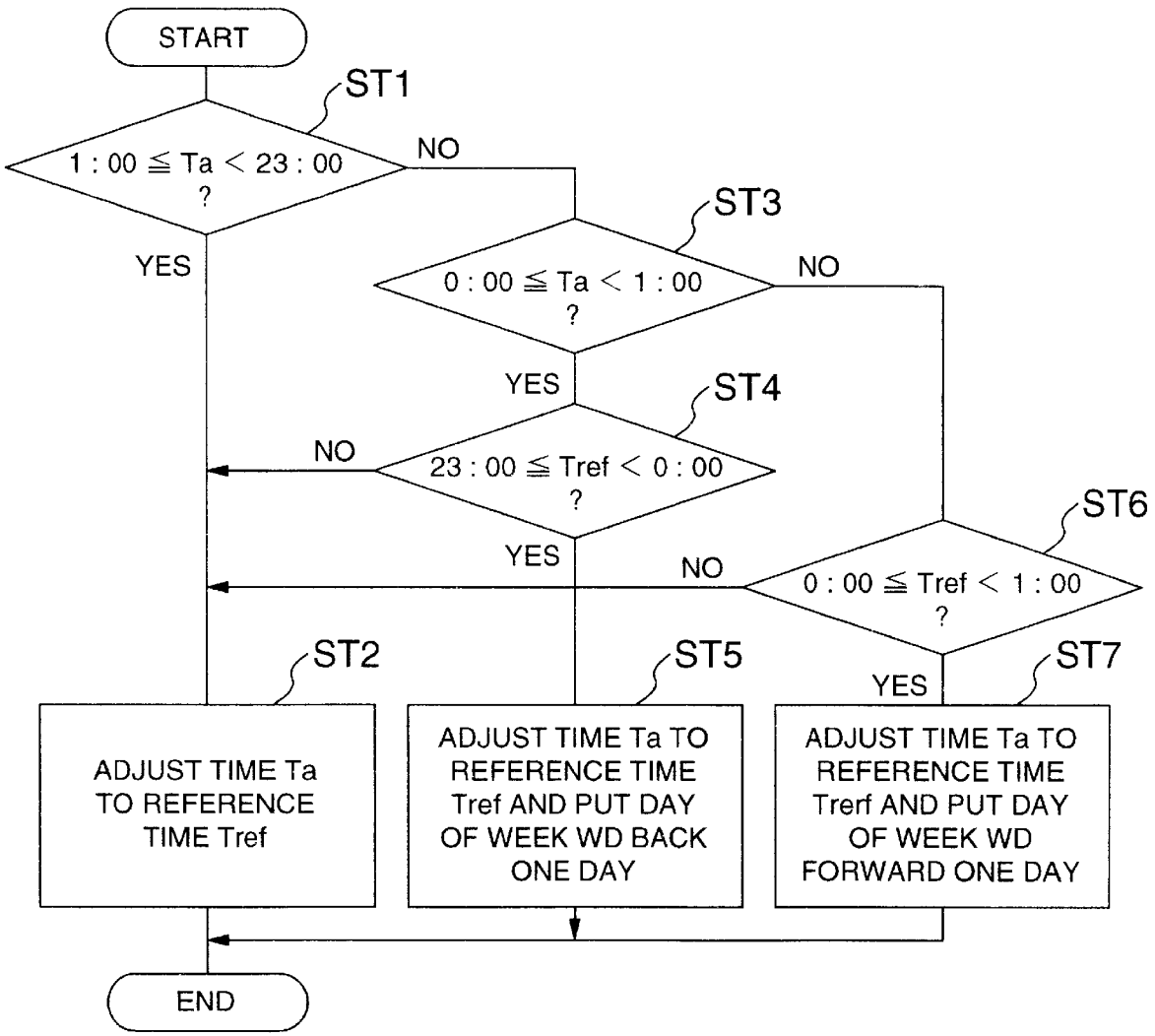
FIG. 3 is a flow chart showing an operation for adjustment of a clock portion.

FIG. 4 shows the result of adjustment when the adjustment operation shown by the flow chart of FIG. 3 is performed. It is shown that when the time Ta of the clock portion 203 is in a first time range, that is, equal to "0:00" or after "0:00" and before "1:00" and the reference time Tref based on the information data signal DS is in a second time range, that is, equal to "23:00" or after "23:00" and before "0:00", the correct adjustment of the clock portion 203 is performed with the day of the week put back one day.

Also, when the time Ta of the clock portion 203 is in a third time range, that is, equal to "23:00" or after "23:00" and before "1:00" and the reference time Tref based on the information data signal DS is in a fourth time range, that is, equal to "0:00" or after "0:00" and before "1:00", the correct adjustment of the clock portion 203 is performed with the day of the week put forward one day.

Thus, when the time Ta of the clock portion 203 of the audio equipment indicates a time of the next day as compared with the reference time Tref from the roadcasting station, the time Ta is set at the correct reference time Tref while the day of the week WD is put back one day. Also, when the time Ta of the clock portion 203 of the audio equipment indicates a time of the preceding day as compared with the reference time Tref from the broadcasting station, the time Ta is set at the correct reference time Tref while the day of the week WD is put forward one day. Accordingly, it is possible to correctly adjust not only a time Ta but also a day of the week WD of the clock portion 203 on the basis of only time information from the broadcasting station.

The adjustment of the clock portion 203 may be performed using the announcement of time in lieu of the reference time Tref. Such adjustment of the clock portion based on the announcement of time can be realized using time information CT (clock time) which is a part of the data DT from the decoder unit 14 in the construction shown in FIG. 2.

Figures 5, 6:
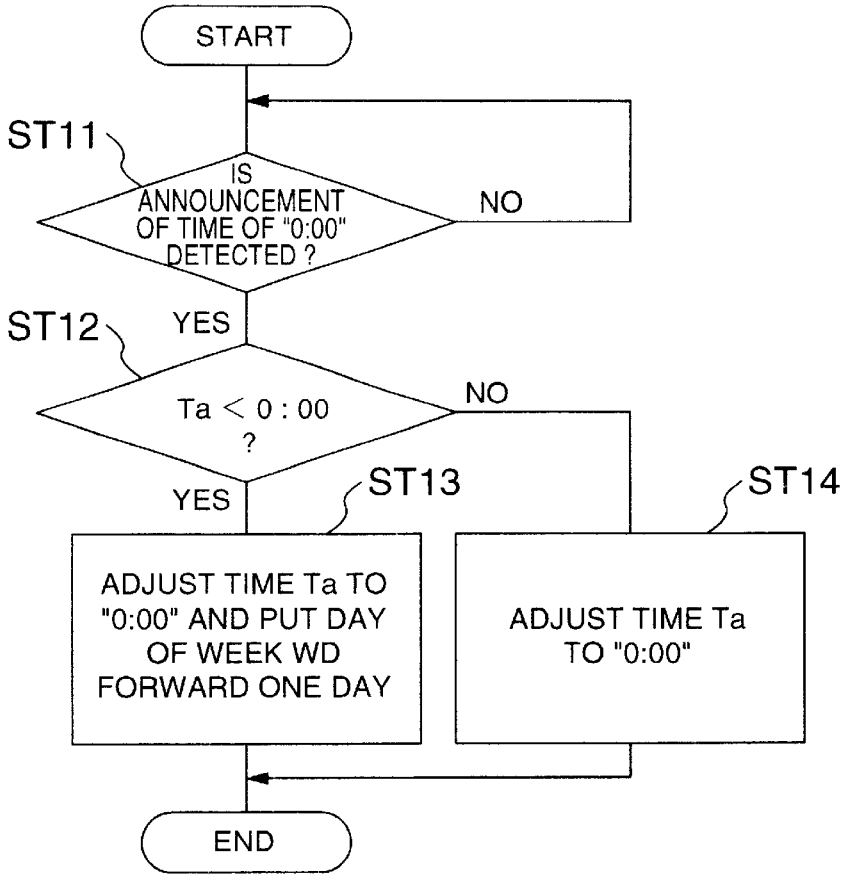
FIG. 5 is a flow chart showing another operation for adjustment of the clock portion.
FIG. 6 is a table for explaining the case where a day of the week is not correctly adjusted.

FIG. 5 is a flow chart showing the operation for adjustment of the clock portion 203 using the announcement of time. In step ST11, the judgement is made of whether or not the announcement of time of "0:00" is detected. The judgement of detection of the announcement of time of "0:00" can be made by setting a detection time range on the basis of a time Ta indicated by a clock information signal TS from the clock portion 203 and judging whether or not an announcement-of-time detection signal AT is supplied to the control unit 20 in he set detection time range, for example, in a range in which the time Ta of the clock portion 203 is between "23:30" and "0:30".

When the announcement of time of "0:00" is detected in the detection time range, the flow proceeds to step ST12. On the other hand, when the announcement of time is not detected, the flow returns to step ST11 to successively carry out the detection of the announcement of time of "0:00" in the detection time range. Though not shown, the operation for adjustment is completed when the time Ta of the clock portion 203 exceeds the detection time range.

In step ST12, the judgement is made of whether or not the time Ta of the clock portion 203 at the time of detection of the announcement of time of "0:00" is before "0:00". When the time Ta of the clock portion 203 at the time of detection of the announcement of time of "0:00" is before "0:00", the flow proceeds to step ST13. When it is equal to "0:00" or after "0:00", the flow proceeds to step ST14.

In step ST13, the time Ta of the clock portion 203 is adjusted to "0:00" and a day of the week is put forward one day, thereby completing the operation for adjustment. In step ST14, on the other hand, the time Ta of the clock portion 203 is adjusted to "0:00" with a day of the week not changed, thereby completing the operation for adjustment.

Thus, when the time Ta of the clock portion 203 of the audio equipment at the time of detection of the announcement of time of "0:00" is in a fifth time range, that is, a range from a time "23:00" of the preceding day as compared with the reference time "0:00" to a time before "0:00", the time Ta is set at "0:00" while the day of the week WD is put forward one day. Accordingly, it is possible to correctly adjust a time Ta and a day of the week WD of the clock portion 203.

The foregoing embodiment has been described in conjunction with the case where a clock of an audio equipment is adjusted. However, the present invention is not limited to the audio equipment or is applicable to any electronic equipment so long as the electronic equipment has a weekly timer function, that is, the electronic equipment can perform a desired operation with a day of the week and a time designated. Also, it is of course that the first to fifth time ranges are not limited to those shown in the foregoing embodiment since the time range may be set properly with a reference made to "0:00".

According to the present invention, a time and a day of the week indicated by clock means are correctly adjusted by discriminating the time of the clock means and a reference time obtained through the reception of broadcasting waves multiplexed with reference time information and adjusting the day of the week of the clock means on the basis of the result of discrimination while setting the time of the clock means at the reference time. Therefore, it is possible to adjust the lock means simply and correctly on the basis of only time information with no need to obtain information of a day of the week by performing a complicated operation processing from information indicative of a date.

The adjustment of the clock means is also possible using the announcement of time of 0:00 a.m. Therefore, it is possible to adjust the clock means simply and correctly even if reference time information multiplexed on broadcasting waves is only the announcement of time.

What is claimed is:

1. A clock adjusting method comprising:

a step in which a reference time is received through broadcasting waves;

a step in which said reference time and a time indicated by a clock portion of an electronic equipment are compared;

a step in which said time indicated by said clock portion is set at said reference time if said time and said reference time compared are different; and a step in which a day of the week indicated by said clock is correctly adjusted based only on said time of said clock and said reference time compared by one of the following two operations;

when said time of said clock portion is in a first time range from 0:00 a.m. and said reference time is in a second time range before 0:00 a.m., said day of the week indicated by said clock portion is put back one day and when said time of said clock portion is in a third time range before 0:00 a.m. and said reference time is in a fourth time range from 0:00 a.m., said day of the week of said clock portion is put forward one day.

2. An electronic equipment provided with clock means for performing an operation based on a day of the week and a time indicated by said clock means, comprising:

receiving means for receiving broadcasting waves with reference time information to obtain a reference time; and clock adjusting means for adjusting said time and said day of the week based only on time information by discriminating a relationship between the time indicated by said clock means and the reference time obtained by said receiving means so that the day of the week indicated by said clock means is adjusted on the basis on the result of discrimination and the time indicated by said clock means is set at the reference time obtained by said receiving means.

3. An electronic equipment according to claim 2, wherein said clock adjusting means puts the day of the week of said clock means back one day in the case where the result of discrimination indicates that when the time indicated by said clock means is in a first time range from 0:00 a.m., said reference time is in a second time range before 0:00 a.m. and puts the day of the week of said clock means forward one day in the case where the result of discrimination indicates that when the time indicated by said clock means is in a third time range before 0:00 a.m., said reference time is in a fourth time range from 0:00 a.m.

4. An electronic equipment according to claim 2, wherein said receiving means obtains said reference time by detecting the announcement of time of 0:00 a.m., and said clock adjusting means puts the day of the week of said clock means forward one day in the case where said announcement of time of 0:00 a.m. is detected by said receiving means when the time indicated by said clock means is in a fifth time range before 0.00 a.m.

5. An electronic equipment according to claim 4, wherein said clock adjusting means sets the time of said clock means at said announcement time of 0:00 a.m. with the day of the week of said clock means being not put forward in the case where said time indicated by said clock is detected in a sixth time range from 0:00 a.m.

* * * * *